United States Patent [19]

Dinwoodie et al.

[11] Patent Number: 4,818,633

[45] Date of Patent: Apr. 4, 1989

[54] FIBRE-REINFORCED METAL MATRIX COMPOSITES

[75] Inventors: John Dinwoodie, Eastham Wirral; Martyn H. Stacey, Northwich; Michael D. Taylor, Gt Barrow; Andrew M. Walker, Guilden Sutton, all of England

[73] Assignee: Imperial Chemical Industries PLC, London, England

[21] Appl. No.: 928,455

[22] Filed: Nov. 10, 1986

[30] Foreign Application Priority Data

Nov. 14, 1985 [GB] United Kingdom ..... 8528156

[51] Int. Cl.[4] ..... C22C 1/09

[52] U.S. Cl. ..... 428/614; 428/924

[58] Field of Search ..... 428/608, 614, 611, 924

[56] References Cited

U.S. PATENT DOCUMENTS

| | | | |
|---|---|---|---|
| 3,808,015 | 4/1974 | Seufort | 501/95 |
| 3,853,688 | 12/1974 | D'Ambrosio | 501/95 |
| 4,012,204 | 3/1977 | Riewald | 148/437 |
| 4,036,599 | 7/1977 | Dhingra | 428/608 |
| 4,274,289 | 7/1981 | Ban et al. | 164/97 |
| 4,370,390 | 1/1983 | Burk | 428/614 |
| 4,457,979 | 7/1984 | Donomoto et al. | 428/614 |
| 4,515,866 | 5/1985 | Okamoto et al. | 428/614 |
| 4,572,271 | 2/1986 | Nakashima et al. | 164/97 |
| 4,590,132 | 5/1986 | Donomoto et al. | 428/614 |
| 4,595,638 | 6/1986 | Donomoto et al. | 428/614 |
| 4,601,956 | 7/1986 | Donomoto et al. | 428/614 |

FOREIGN PATENT DOCUMENTS

| | | | |
|---|---|---|---|
| 188704 | 7/1986 | European Pat. Off. | 428/614 |

*Primary Examiner*—John J. Zimmerman

*Attorney, Agent, or Firm*—Cushman, Darby & Cushman

[57] ABSTRACT

A metal matrix composite comprises randomly-oriented inorganic oxide fibres of density below 3 g/ml embedded in a metal matrix material such as a light metal, for example aluminium or magnesium or an alloy thereof. In a particular embodiment the fibres are of density 1.8 to 2.5 g/ml and preferably are of mean diameter from 2 to 10 microns. The composite can be made by liquid infiltration of a fibre preform comprising the fibres bound together with an inorganic or an organic binder or by extrusion of a mixture of the fibres and a powdered metal matrix material.

10 Claims, No Drawings

FIBRE-REINFORCED METAL MATRIX COMPOSITES

This invention relates generally to the reinforcement of metals with inorganic fibres and more particularly to fibre-reinforced metal matrix composites comprising porous, low-density inorganic oxide fibres, notably alumina fibres, embedded as reinforcement in a metal matrix. The invention includes preforms made of porous low-density inorganic oxide fibres suitable for incorporation as reinforcement in a metal matrix.

Metal matrix composites (hereinafter abbreviated to MMCs) are known comprising inorganic oxide fibres such as polycrystalline alumina fibres embedded as reinforcement in a matrix comprising a metal such as aluminium or magnesium or an alloy containing aluminium or magnesium as the major component. A fibre commonly used in such MMCs is alumina fibre in the form of short (e.g. up to 5 mm), fine-diameter (e.g. mean diameter 3 microns) fibres which are randomly oriented at least in a plane perpendicular to the thickness direction of the composite material. MMCs of this type containing alumina fibres in alloys have begun to be used in industry in a number of applications, notably in pistons for internal combustion engines wherein the ring-land areas and/or crown regions are reinforced with the alumina fibres.

MMCs containing aligned, continuous fibres such as alumina fibres and steel fibres have also been proposed for use in applications where uni-directional strength is required, for example in the reinforcement of connecting rods for internal combustion engines. In MMCs of this type, the fibres are of relatively large diameter, for example at least 8 and usually at least 10 microns diameter, and in the case of alumina fibres comprise a high proportion, for example from 60 to 100%, of alpha alumina.

The metal matrices in respect of which fibre reinforcement is of most interest are the so-called light metals and alloys containing them, particularly aluminium and magnesium and their alloys. The density of such metals is typically about 1.8 to 2.8 g/ml and since the inorganic oxide fibres used hitherto as reinforcement have a density greater than 3, typically about 3.3 to 3.9 g/ml a disadvantage of the resulting MMCs is that they are more dense than the metal itself. Thus for example an MMC consisting of an aluminium alloy of density 2.8 reinforced with 50% by volume of alumina fibre of density 3.9 will have a density of about 3.35. It would clearly be advantageous if incorporation of a fibre reinforcement in the metal produced an MMC of reduced or at least not significantly greater density than the metal itself.

According to the invention there is provided a metal matrix composite comprising randomly oriented inorganic oxide fibres of density less than 3.0 g/ml embedded in a metal matrix material.

Also according to the invention there is provided a preform suitable for incorporation in a metal matrix material to produce a metal matrix composite in accordance with the immediately-preceding paragraph and comprising randomly oriented inorganic oxide fibres of density less than 3.0 g/ml bound together with a binder, preferably an inorganic binder.

Enhancement of the properties of metals by incorporating a fibre reinforcement therein is related to the strength and modulus of the fibres employed, it being desirable that the fibres be of high tensile strength and high modulus.

Accordingly, in preferred embodiments of the invention there are provided MMCs and preforms in which the fibres are of tensile strength greater than 1500, preferably greater than 1750, MPa and modulus greater than 100 GPa.

The inorganic oxide fibres may if desired be used in admixture with other types of fibres, for example aluminosilicate fibres (density about 2.8 g/ml) or silicon carbide whiskers (density about 3.2 g/ml), the proportion of inorganic oxide fibres in such mixtures typically being from 40% to 80% of the fibres. The inorganic oxide fibres may comprise the oxides of more than one metal, a particular example of such a fibre being an alumina fibre containing a few percent by weight, say 4 or 5 percent by weight, of a phase stabilizer such as silica.

The volume fraction of the fibres in the MMC (and in the preform) may vary within wide limits depending upon the required duty of the MMC. As a guide, volume fractions of up to 50% to 60%, typically from 30% to 40%, of the MMC can be achieved. MMC may contain, for example, from 0.1 to 2 g/ml of fibres, preferably at least 0.3 g/ml and typically from 0.8 to 1.6 g/ml or even higher. The fibre content of the MMC may vary throughout the thickness of the composite. Changes in fibre content may be uniform or step-wise. An embodiment of an MMC comprising a step-wise variation of fibre content is provided by a laminate of MMCs of different fibre content, the composites being separated if desired in an integral laminate by a layer of the metal e.g. a sheet of aluminium. Multi-layer composites can be built up as desired. The MMC may have a backing sheet of a suitable textile fabric, for example Kevlar fabric.

Preferably the fibres have a tensile strength of at least 1000 MPa and a modulus of at least 70 GPa and preferably at least 100 GPa. They should preferably be essentially chemically inert towards the metal forming the matrix so that fibre properties are not degraded, although some reactions with the fibres can be tolerated, for example reactions which enhance the bonding between the metal and the fibres. The fibres preferably should be easily wetted by the metal.

The preferred fibre is porous polycrystalline alumina fibre since such fibre exhibits a good balance of desirable properties such as high strength, high stiffness, hardness, low-density and chemical inertness towards metals such as aluminium and magnesium. A typical polycrystalline alumina fibre of diameter about 3 microns has a strength of 1500–2000 MPa, a modulus of 150–200 GPa and a density of about 2.0 to 2.5 g/ml.

The fibres are randomly oriented and may be short staple (say a few cm) fibres, milled staple (say 50 to 1000 microns) being preferred. Fibre length has an important affect upon the packing density of the fibres in preforms in which the fibres are arranged in random or planar random orientation, and thus upon the volume fraction of the fibres in the MMC. In general, high volume fractions of fibres require very short fibres, for example fibres of length below 500 microns and as low as 10 or 20 microns, depending to some extent upon the particular fibres used and particularly their diameter and stiffness. There is a critical minimum fibre length in order that the fibres afford maximum tensile strength enhancement of the metal matrix.

However, where a significant increase in tensile strength is not so important, fibres of length below the critical length may be used to provide an MMC of reduced density with no loss of tensile strength in the composite but with increased wear resistance and stiffness/modulus. In such cases, the fibres may be extremely short, e.g. a few microns, so that they resemble powders.

As stated above, the critical length of fibres should be exceeded in order that the tensile strength of the metal matrix is significantly enhanced and maximum benefit in respect of the tensile strength generally is achieved when the actual fibre length exceeds the critical length by about a factor of 10. The critical length depends upon the proportions of the particular fibres and metal employed and the temperature at which the resulting MMC is designed to operate. In the case of polycrystalline alumina fibres of average diameter 3 microns, fibre lengths up to about 1000 microns are preferred but for composites of high volume fraction fibres, fibre lengths between 100 and 500 microns are typical. Where the resulting MMC is designed for low-temperature duty only, fibre lengths as low as 20 microns may be acceptable. As a general guide, we prefer the maximum fibre length consistent with a high volume fraction of fibres.

Fibre diameter may vary over a wide range, for example from 2 microns to 100 microns. Fine fibres provide the highest volume fractions of fibres in the MMCs and diameters in the range 2 to 10 microns are preferred. Polycrystalline alumina fibres of diameter about 3 microns and length 10–200 microns are especially suitable for achieving high volume fractions of fibres in the MMCs. It is to be understood, however, that fibre lengths quoted herein refer to the length in the MMC and these lengths may be smaller than the fibres used to form the MMC since some breakdown of the fibres (which are hard and brittle) may occur during production of the MMC. Generally, longer fibres may be used to make the composite than are described above.

The preferred fibres in the fibre reinforcement are low-density alumina fibres. In this case the alumina fibres comprise wholly a transition alumina or a minor proportion of alpha-alumina embedded in a matrix of a transition alumina such as gamma-, delta- or eta-alumina. We prefer fibres comprising zero or a very low alpha-alumina content and in particular an alpha-alumina content of below 1% by weight.

The preferred fibres exhibit acceptable tensile strengths and have a high flexibility. In a particular embodiment of the invention, the fibres have a tensile strength greater than 1500 MPa, preferably greater than 1750 MPa, and a modulus greater than 100 GPa. Typical apparent densities for the low density fibres are 2 g/ml to 2.5 g/ml although fibres of any desired density within the range 1.8 to 3.0 g/ml can be obtained by careful control of the heat treatment to which the fibres are subjected. In general, fibres heated at lower temperatures, say 800°–1000° C., have lower density and lower tensile strength and modulus than fibres heated at higher temperatures, say 1100°–1300° C. By way of a guide, low density fibres exhibit tensile strengths about 1500 MPa and modulus about 150 GPa whilst higher density fibres exhibit strengths and modulus about 1750 MPa and 200 GPa respectively. We have observed, though, that the modulus of the low density fibres does not appear to be greatly affected by the heat treatment program to which the fibres have been subjected and does not vary greatly in accordance with the apparent density of the fibres. Therefore the ratio of fibre modulus to fibre density (=specific modulus) is generally greatest in respect of the lower density fibres.

The fibres can be produced by a blow-spinning technique or a centrifugal spinning technique, in both cases a spinning formulation being formed into a multiplicity of fibre precursor streams which are dried at least partially in flight to yield gel fibres which are then collected on a suitable device such as a wire or carrier belt.

The spinning formulation used to produce the fibres may be any of those known in the art for producing polycrystalline metal oxide fibres and preferably is a spinning solution free or essentially free from suspended solid particles of size greater than 10, preferably of size greater than 5, microns. The rheology characteristics of the spinning formulation can be readily adjusted, for example by use of spinning aids such as organic polymers or by varying the concentrations of fibre-forming components in the formulation.

Any metal may be employed as the matrix material which melts at a temperature below about 1200° C., preferably below 950° C.

A particular advantage of the invention is improvement in the performance of light metals so that they may be used instead of heavy metals and it is with reinforcement of light metals that the invention is particularly concerned. Examples of suitable light metals are aluminium, magnesium and titanium and alloys of these metals containing the named metal as the major component, for example representing greater than 80% or 90% by weight of the alloy.

As is described hereinbefore, the fibres are porous, low density materials and since the fibres can constitute 50% or more by volume of the MMC the density of the fibres can significantly affect the density of the MMC. Thus, for example, a magnesium alloy of density about 1.9 g/ml reinforced with 30% volume fraction of fibres of density 2.3 g/ml will provide an MMC of density about 2.0 g/ml, i.e. only slightly denser than the alloy itself; conversely an aluminium alloy of density 2.8 g/ml reinforced with 30% volume fraction of fibres of density 2.1 g/ml will provide an MMC of density 2.65 g/ml, i.e. less dense than the alloy itself.

The present invention thus enables MMCs to be produced having a predetermined density within a wide range. Aluminium and magnesium and their alloys typically have a density in the range 1.8 to 2.8 g/ml and since the density of the fibres can vary from about 2.0 to 3.0 g/ml, MMCs of density 1.9 to about 3.0 g/ml can readily be produced. An especially light metal or alloy reinforced with an especially light fibre is a preferred feature of the invention, in particular magnesium or a magnesium alloy of density less than 2.0 g/ml reinforced with a porous, low-density fibre (notably an alumina fibre) of density about 2.0 g/ml to provide an MMC of density less than 2.0 g/ml.

If desired the surface of the fibres may be modified in order to improve wettability of the fibres by and/or the reactivity of the fibres towards the metal matrix material. For example the fibre surface may be modified by coating the fibres or by incorporating a modifying agent in the fibres. Alternatively, the matrix material may be modified by incorporating therein elements which enhance the wettability and reduce the reactivity of the inorganic oxide fibres, for example tin, cadmium, antimony, barium, bismuth, calcium, strontium or indium.

In one process for making MMCs, described hereinafter, the fibres are first assembled into a preform wherein the fibres are bound together by a binder, usually an inorganic binder such as silica or alumina. It is possible to incorporate elements in the binder which enhance the wettability and reduce the reactivity of the fibres during infiltration of the preform.

We have observed that generally application of pressure or vacuum to facilitate infiltration of alumina-fibre preforms with the metal matrix material obviates any problems of wetting of the fibres by the matrix material and the preform/infiltration technique is one of our preferred techniques for making the MMCs of the invention.

In a preferred preform/infiltration technique, the molten metal may be squeezed into the preform under pressure or it may be sucked into the preform under vacuum. In the case of vacuum infiltration, wetting aids may be desirable. Infiltration of the metal into the preform may be effected in the thickness direction of the preform or at an angle, say of 90°, to the thickness direction of the preform and along the fibres.

Infiltration of the molten metal into the preform may in the case of aluminium or aluminium alloys be carried out under an atmosphere containing oxygen, e.g. ambient air, but when using certain metal matrix materials such as, for example, magnesium and magnesium alloys, oxygen is preferably excluded from the atmosphere above the molten metal. Molten magnesium or an alloy thereof is typically handled under an inert atmosphere during infiltration thereof into the preform, for example an atmosphere comprising a small amount (e.g. 2%) of sulphur hexafluoride in carbon dioxide.

Preparation of preforms for infiltration by molten metal matrix materials can be effected by a wide variety of techniques, including for example extrusion, injection moulding, compression moulding and spraying or dipping. Such techniques are well known in the production of fibre-reinforced resin composites and it will be appreciated that use of a suspension of binder(s) instead of a resin in the known techniques will yield a preform.

A technique using a fibre pre-form is preferred in order to achieve a high volume fraction of fibres in the metal matrix composite. A useful technique for forming a fibre pre-form of high volume fraction fibres comprises forming a slurry of short fibres in a liquid, usually an aqueous, medium and allowing the liquid medium to drain from the slurry in a mould. Drainage of liquid may be assisted by high pressure or vacuum, if desired. An inorganic binder and optionally also an organic binder, e.g. rubber latex which may be burned out subsequently (if desired), will usually be incorporated in the slurry to impart handling capability to the resulting fibre preform. For preforms to be infiltrated with aluminium or its alloys, silica is a suitable binder but for preforms to be infiltrated with magnesium or its alloys we prefer to employ zirconia as the binder since a reaction may occur if silica is employed. Amounts of binder of from 1% to 15% by weight of the fibres may be employed. If desired, the preform may be compacted by pressure whilst still wet, e.g. during drying to increase the packing density of the fibres and hence the volume fraction of fibres in the preform.

One or more additives may be incorporated in the fibre pre-form prior to infiltration thereof with metal. Thus, for instance, fillers such as alumina and other ceramic powders may be incorporated in the fibre preform as may other modifiers such as organic fibres and other organic materials. A convenient method for incorporating the additives is to mix them into and uniformly distribute them in the slurry from which the fibre pre-form is produced.

Other techniques for producing bonded preforms include hand lay-up techniques and powder-compaction techniques. In hand lay-up techniques thin samples of fibrous materials, e.g. woven or non-woven sheet materials, are impregnated with a suspension of binder(s) and multiple layers of the wet, impregnated sheets are assembled by hand and the assembly is then compressed in a die or mould to yield an integral preform.

The binder used to form the preform may be an inorganic binder or an organic binder or a mixture thereof. Any inorganic or organic binder may be used which (when dried) binds the fibres together to an extent such that the preform is not significantly deformed when infiltrated by a molten metal matrix material. Examples of suitable inorganic binders are silica, alumina, zirconia and magnesia and mixtures thereof. Examples of suitable organic binders are carbohydrates, proteins, gums, latex materials and solutions or suspensions of polymers. Organic binders used to make the preform may be fugitive (i.e. displaced by the molten metal) or may be burned out prior to infiltration with molten metal.

The amount of binder(s) may vary within a wide range of up to about 50% by weight of the fibres in the preform but typically will be within the range of 10% to 30% by weight of the fibres. By way of a guide, a suitable mixed binder comprises from 1 to 20%, say about 15%, by weight of an inorganic binder such as silica and from 1 to 10%, say about 5%, by weight of an organic binder such as starch. In the case where the binder is applied in the form of a suspension in a carrier liquid, an aqueous carrier liquid is preferred.

As is discussed hereinbefore, the MMCs of the invention can be made by infiltration of a preform. Alternatively, any of the techniques described for making preforms may be adapted for making MMCs directly by employing a metal matrix material instead of a binder or mixture of binders. Alternatively, MMCs can be made by powder compaction techniques in which a mixture of fibres and metal (powder) is compacted at a temperature sufficient to melt or soften the metal to form an MMC directly or to form a preform or billet which is further processed into the finished MMC for example by hot compaction, extrusion or rolling. The mixture of fibres and metal (powder) may be made, for example, by a hand lay-up technique in which layers of fibres and metal are assembled in a mould ready for hot-compaction.

Extrusion of a preform or billet of fibres and metal powder is a particularly preferred technique for making the MMCs of the invention, as also is extrusion of an aggregate of fibres and metal powder packed or "canned" into a form suitable for extrusion.

An especially preferred technique for making a preform or billet of fibres and metal powder suitable for extrusion or other processing into finished MMCs comprises dispersing the fibres and metal powder in a liquid carrier medium such as an alcoholic medium and depositing the fibres and metal powder on e.g. a wire screen by vacuum filtration. If desired one or more binders, which may be organic or inorganic binders, may be incorporated in the dispersion (and hence in the preform or billet). The preform or billet is then dried, optionally under vacuum, before further processing by, for example, hot-compaction, extrusion or hot-working such as rolling or the Conform process.

A useful technique for making MMCs comprises extrusion of a mixture of fibres and metal made for example by stir-casting or rheo-casting, in which fibres, optionally pre-heated, are stirred into molten metal which is then cast or extruded or formed into a billet for subsequent extrusion. Other techniques include chemical coating, vapour deposition, plasma spraying, electro-chemical plating, diffusion bonding, hot rolling, isostatic pressing, explosive welding and centrifugal casting.

In making MMCs by any of the above techniques, care needs to be exercised to prevent the production of voids in the MMC. In general, the voidage in the MMC should be below 10% and preferably is below 5%; ideally the MMC is totally free of voids. The application of heat and high pressure to the MMC during its production will usually be sufficient to ensure the absence of voids in the structure on the MMC.

The MMCs according to the invention may be used in any of the applications where fibre-reinforced metals are employed, for example in the motor industry and for impact resistance applications. The MMC may, if desired, be laminated with other MMCs or other substrates for example sheets of metal.

The invention is illustrated by the following Examples in which fibre preforms were made as follows:

PREPARATION OF FIBRE PREFORM

Alumina fibre pre-forms were made from alumina fibres of density 2.0 g/ml by the following general procedure.

Chopped alumina fibre (1 Kg) of average diameter 3 microns and length approximately 500 microns was added to water (100 Kg) together with silica (50 g added as a 27% w/w silica sol) and the mixture was stirred to thoroughly disperse the fibres. A solution of a cationic starch was added to flocculate the silica and the suspension was poured onto a wire mesh screen in a mould and the water was drained off through the screen to yield a coherent pad of fibres in which the fibres were randomly oriented in two-dimensional planes parallel to the large faces of the pad. The pad of fibres was compressed whilst still wet to increase the volume fraction of fibres in the pad after which the compressed pad was dried and heated to 950°-1000° C. to sinter the inorganic binder to increase the strength of the bond between the silica binder and the alumina fibres. The resulting pad or fibre pre-form was removed from the mould and used to form a metal matrix composite as is described hereinafter. Using this technique, fibre preforms were prepared having volume fractions of fibre in the range 0.12 to 0.3.

EXAMPLE 1

A fibre preform of volume fraction fibres 0.2 was preheated to 750° C. and placed in a die preheated to 300° C. and molten metal at a temperature of 840° C. was poured onto the preform. The metal was an aluminium alloy available as LM 10 and of approximate %age composition 90 Al, and 10 Mg.

The molten metal was forced into the preform under a pressure of 20 MPa applied by a hydraulic ram (preheated to 300° C.) for a period of 1 minute. The resulting billet (MMC) was demoulded and cooled to room temperature and its properties were measured. The results are shown in Table 1 below where they are compared with the properties of an unreinforced metal matrix.

TABLE 1

| Volume Fraction Fibres in Preform | Density (g/ml) | Ultimate Tensile Strength (MPa) | Modulus (GPa) | *Relative Specific Strength | *Relative Specific Modulus |
|---|---|---|---|---|---|
| 0 | 2.6 | 190 | 70 | 1.0 | 1.0 |
| 0.2 | 2.48 | 249 | 79.4 | 1.37 | 1.19 |

*Relative to a value of 1.0 for unreinforced alloy; thus for the composite, specific tensile strength was 10.04 ($\times 10^5$ cm) compared with 7.31 ($\times 10^5$ cm) for the alloy and specific modulus was 3.20 ($\times 10^7$ cm) compared with 2.69 for the alloy.

EXAMPLE 2

Using the technique and conditions described in Example 1, four composites were prepared having volume fractions of fibres 0.1, 0.2, 0.3 and 0.4 respectively. The matrix metal was an alloy of aluminium with Mg, Si and Cu and is available as Al-6061.

| Volume fraction fibres | Composite density (g/ml) |
|---|---|
| 0 | 2.70 |
| 0.1 | 2.63 |
| 0.2 | 2.56 |
| 0.3 | 2.49 |
| 0.4 | 2.42 |

It was observed that increasing the volume fraction of fibres in the composites results in an increase in the modulus of the composites and a decrease in the density of the composites; thus specific modulus is greatly enhanced compared with the unreinforced alloy.

EXAMPLE 3

The procedure described in Example 1 was repeated twice using LM-10 and preforms of volume fraction fibres 0.2 made from alumina fibres of density 2.5 g/ml.

| | Volume fraction fibres (g/ml) | Composite density (g/ml) | Ultimate Tg Composite (MPa) | Modulus (GPa) | Relative Specific Strength | Relative Specific Modulus |
|---|---|---|---|---|---|---|
| Expt. 1 | 0.3 | 2.57 | 232 | 99 | 1.24 | 1.43 |
| Expt. 2 | 0.3 | 2.57 | 248 | 93 | 1.32 | 1.35 |

EXAMPLE 4

Alumina fibre/magnesium composites were prepared by the technique described in Example 1 from alumina fibres of density 2.0 g/ml and commercial purity (99.9%) magnesium. The casting conditions were:

Pouring temperature: 850° C.
Preform temperature: 750° C.
Die temperature: 350° C.
Pressure: 17 MPa Casting was carried out under an atmosphere of 2% ST6 in $CO_2$ gas.

| Volume fraction fibres | Composite density (g/ml) |
|---|---|
| 0 | 1.8 |
| 0.2 | 1.84 |
| 0.4 | 1.88 |

Thus incorporation of 20 volume percent fibres increased the density of the magnesium by only 2.2%.

We claim:

1. A metal matrix composite comprising randomly oriented alumina fibres wherein the density of the individual fibres is from 1.8 to 2.5 g/ml embedded in a metal matrix material of density from 1.8 to 2.8 g/ml.

2. A metal matrix composite as claimed in claim 1 wherein the mean diameter of the fibres is from 2 to 10 microns.

3. A metal matrix composite as claimed in claim 1 or claim 2 wherein the loading of fibres is from 10% to 60% by volume.

4. A composite as claimed in claim 1 wherein the fibres contain silica.

5. A composite as claimed in claim 1 wherein the matrix metal is aluminium or an alloy of aluminium.

6. A composite as claimed in claim 1 comprising an alumina fibre preform infiltrated with a metal matrix material wherein the density of the metal matrix composite is less than the density of the metal matrix material.

7. A composite as claimed in claim 1 wherein the matrix metal is magnesium or an alloy of magnesium.

8. A composite as claimed in claim 1 wherein the fibres have a tensile strength greater than 1500 MPa and a modulus greater than 150 GPa.

9. A composite as claimed in claim 7 comprising a matrix metal of density less than 2.0 g/l having embedded therein fibres of apparent density 2 g/ml or less.

10. A composite as claimed in claim 1 comprising an extruded mixture of alumina fibres and a metal matrix material wherein the density of the metal matrix composite is less than the density of the metal matrix material.

* * * * *